US007472974B2

(12) United States Patent
Czach et al.

(10) Patent No.: US 7,472,974 B2
(45) Date of Patent: Jan. 6, 2009

(54) REFRIGERATOR WITH STORAGE BIN

(75) Inventors: Matthew G. Czach, Holland, MI (US); Jonathan P. Van Dore, St. Joseph, MI (US); Marcus W. Franck, St. Joseph, MI (US); Kenneth N. Whah, Valparaiso, IN (US); Richard B. Mills, Evansville, IN (US); David L. Meese, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 245 days.

(21) Appl. No.: 10/908,321

(22) Filed: May 6, 2005

(65) Prior Publication Data

US 2006/0250063 A1 Nov. 9, 2006

(51) Int. Cl.
*A47B 96/04* (2006.01)

(52) U.S. Cl. ..... 312/405.1; 312/321.5

(58) Field of Classification Search ..... 312/321.5, 312/405.1, 327, 328, 404, 351, 348.3, 270.2, 312/270.1, 290; 211/90.02, 150; 108/108, 108/60, 61; 62/441, 440
See application file for complete search history.

(56) References Cited

U.S. PATENT DOCUMENTS

| | | | | | |
|---|---|---|---|---|---|
| 261,027 | A | * | 7/1882 | Nettleton | 312/328 |
| 370,557 | A | * | 9/1887 | Petersen | 312/296 |
| 764,832 | A | * | 7/1904 | Valentine | 312/220 |
| 1,112,296 | A | * | 9/1914 | Kyle | 312/327 |
| 2,498,898 | A | * | 2/1950 | Rieth | 312/7.1 |
| 2,784,047 | A | * | 3/1957 | Wallance | 312/328 |
| 2,874,016 | A | * | 2/1959 | Andrea | 312/328 |
| 3,008,788 | A | * | 11/1961 | Garner | 312/309 |
| 3,698,783 | A | * | 10/1972 | Swett et al. | 312/351 |
| 5,132,725 | A | * | 7/1992 | Findeis et al. | 355/72 |
| 5,346,299 | A | * | 9/1994 | Werkmeister et al. | 312/405.1 |
| 5,954,413 | A | * | 9/1999 | Brown | 312/328 |
| 6,742,855 | B2 | * | 6/2004 | Whitaker et al. | 312/405.1 |
| 6,782,710 | B2 | * | 8/2004 | Eveland et al. | 62/441 |
| 6,983,615 | B2 | * | 1/2006 | Winders et al. | 62/115 |
| D522,542 | S | * | 6/2006 | Czach et al. | D15/89 |
| D527,749 | S | * | 9/2006 | Eveland et al. | D15/89 |
| 2002/0117949 | A1 | * | 8/2002 | Banicevic et al. | 312/407 |
| 2004/0012314 | A1 | * | 1/2004 | Hay et al. | 312/405.1 |
| 2004/0182727 | A1 | * | 9/2004 | Becke et al. | 206/320 |
| 2005/0116596 | A1 | * | 6/2005 | Leimkuehler et al. | 312/405.1 |
| 2006/0156755 | A1 | * | 7/2006 | Ouseph et al. | 62/441 |
| 2006/0279188 | A1 | * | 12/2006 | Alitalo et al. | 312/401 |
| 2007/0113578 | A1 | * | 5/2007 | Wu et al. | 62/344 |

FOREIGN PATENT DOCUMENTS

DE 10339929 * 3/2005

* cited by examiner

*Primary Examiner*—Janet M Wilkens
(74) *Attorney, Agent, or Firm*—Kirk Goodwin; Michael D. Lafrenz

(57) ABSTRACT

A storage bin assembly for mounting to a household refrigerator door comprises a storage bin defining a recess and having an opening to provide access to the recess. The storage bin is movably mounted to the door for movement between an opened position where the recess can be accessed through the opening and a closed position where the opening is sealed with the door. The door can comprise a housing that supports the storage bin and seals with the storage bin when the storage bin is in the closed position. The storage bin can comprise a peripheral wall that defines the recess and terminates at an upper edge defining the opening.

23 Claims, 13 Drawing Sheets

REFRIGERATOR WITH STORAGE BIN

FIELD OF THE INVENTION

The invention relates to a refrigerator, and more specifically to a storage bin assembly for mounting to a refrigerator door.

DESCRIPTION OF THE RELATED ART

Typical household refrigerators comprise two chilled chambers, a refrigerator chamber and a freezer chamber. The chilled chambers are usually equipped with various shelves and compartments mounted to the cabinet or door of the refrigerator for holding and storing food items. The compartments can be designated for specific types of food, depending on the size of the compartment, the location of the compartment in the chilled chamber, and the humidity level in the compartment. For example, the refrigerator chamber can have a drawer mounted to the cabinet for particularly storing produce, such as fruits and vegetables, and such a drawer is typically called a crisper. In some refrigerators, the crisper drawer can be sealed from the rest of the chilled chamber to control the environment, such as temperature and humidity, in the drawer. The sealing helps to keep the produce fresh by preventing air circulating in the chilled chamber from entering the crisper drawer. Excessive exposure to the circulating air can cause the food to dry and prematurely spoil. However, crisper drawers utilize a relatively large amount of space in the chilled chamber. Additionally, they are usually located near the bottom of the chilled chamber and are thereby inconvenient to access and not readily viewable by the user. Oftentimes, a user will select the foods to eat by just looking in the refrigerator and selecting a food time that looks appealing. Because the crisper drawer is not easily observable, the user is more likely to choose a potentially less healthy food item rather than a relatively healthy produce item.

SUMMARY OF THE INVENTION

A storage bin assembly mountable to a door of a household refrigerator comprises a housing and a storage bin. The housing is configured to be mounted to the refrigerator door. The storage bin defines a recess and has an opening to provide access to the recess. The storage bin is movably mounted to the housing for movement between an opened position where the recess can be accessed through the opening and a closed position where the opening is sealed with the housing.

DESCRIPTION OF EMBODIMENTS OF THE INVENTION

Figure 1:
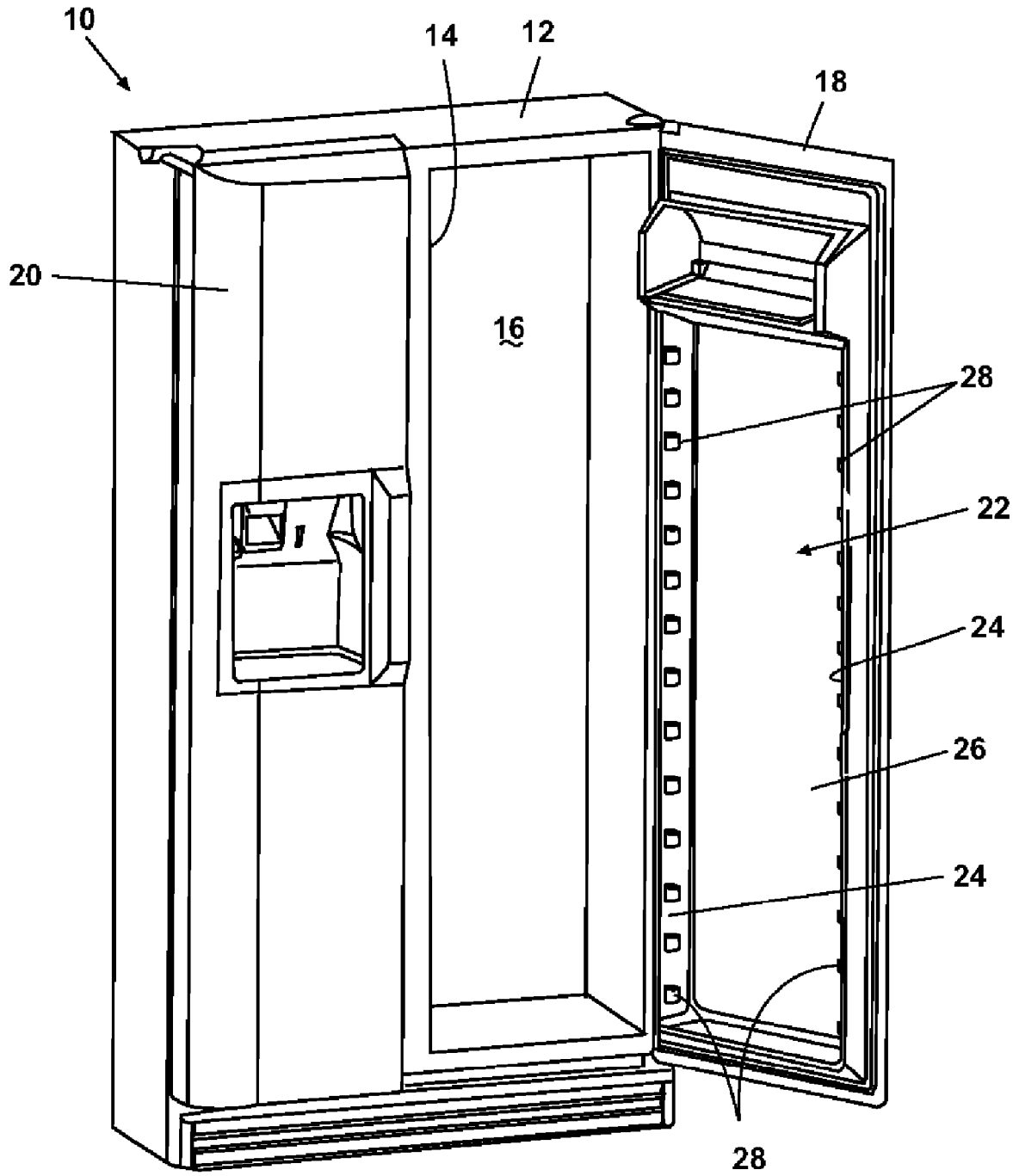
FIG. 1 is a perspective view of a household refrigerator according to one embodiment of the invention.

Referring now to the figures, FIG. 1 illustrates a household refrigerator 10 according to one embodiment of the invention comprising an open-face cabinet 12 with a partition 14 that divides the interior of the cabinet into two chilled chambers: a refrigerator chamber 16 and a freezer chamber (not shown). A refrigerating system (not shown) mounted to the cabinet 12 maintains the temperature of the chilled chambers below ambient temperature, and, typically, the temperature of the freezer chamber is less than the temperature of the refrigerator chamber 16, as is well known in the refrigerator art, illustrative examples of which are shown in U.S. Pat. Nos. 5,490,395 and 5,465,591. The refrigerator 10 illustrated in FIG. 1 is a side-by-side refrigerator where the chilled chambers are horizontally juxtaposed, but it is within the scope of the invention for the chilled chambers to be vertically juxtaposed or for the refrigerator 10 to comprise only one or several chilled chambers.

The chilled chambers are selectively closed by a pair of chilled chamber doors, a refrigerator door 18 for the refrigerator chamber 16 and a freezer door 20 for the freezer chamber, hingedly mounted to the cabinet 12. The doors 18, 20 are commonly insulated to reduce heat transfer between the chilled chambers and the environment exterior of the refrigerator 10 through the doors 18, 20. While the invention will be described with respect to the refrigerator door 18, it will be understood to one of ordinary skill in the art that the freezer door 20 can be substantially identical to the refrigerator door 18, and the invention can be utilized with the freezer door 20 as well as the refrigerator door 18. With continued reference to FIG. 1, the door 18 comprises an inner surface 22 that faces the chamber 16 when the door 18 closes the chamber 16. The inner surface 22 comprises a pair of opposed side walls 24 joined by a rear wall 26, and each of the side walls 24 comprises a plurality of vertically spaced mounting lugs 28. The mounting lugs 28 are equally spaced on both of the side walls 24 to form horizontally aligned pairs of lugs 28. The lugs 28 can support various structures, such as shelves and bins, for holding food items. When the door 18 is closed, the food items held by the structures supported by the lugs 28 are stored within the chamber 16.

Figure 2:
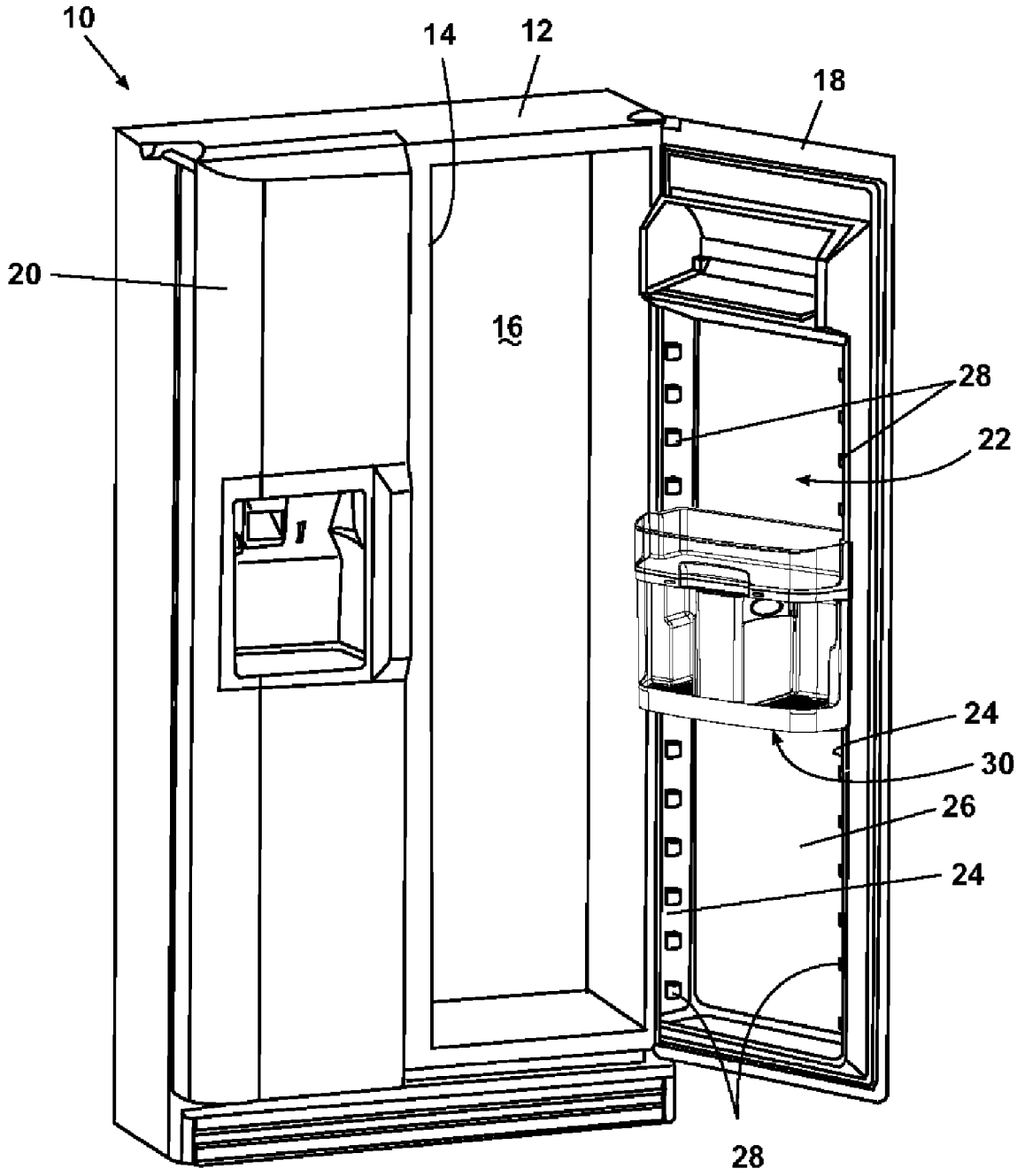
FIG. 2 is a perspective view of the refrigerator of FIG. 1 with a storage bin assembly according to one embodiment of the invention mounted to a door of the refrigerator.
Figure 3:
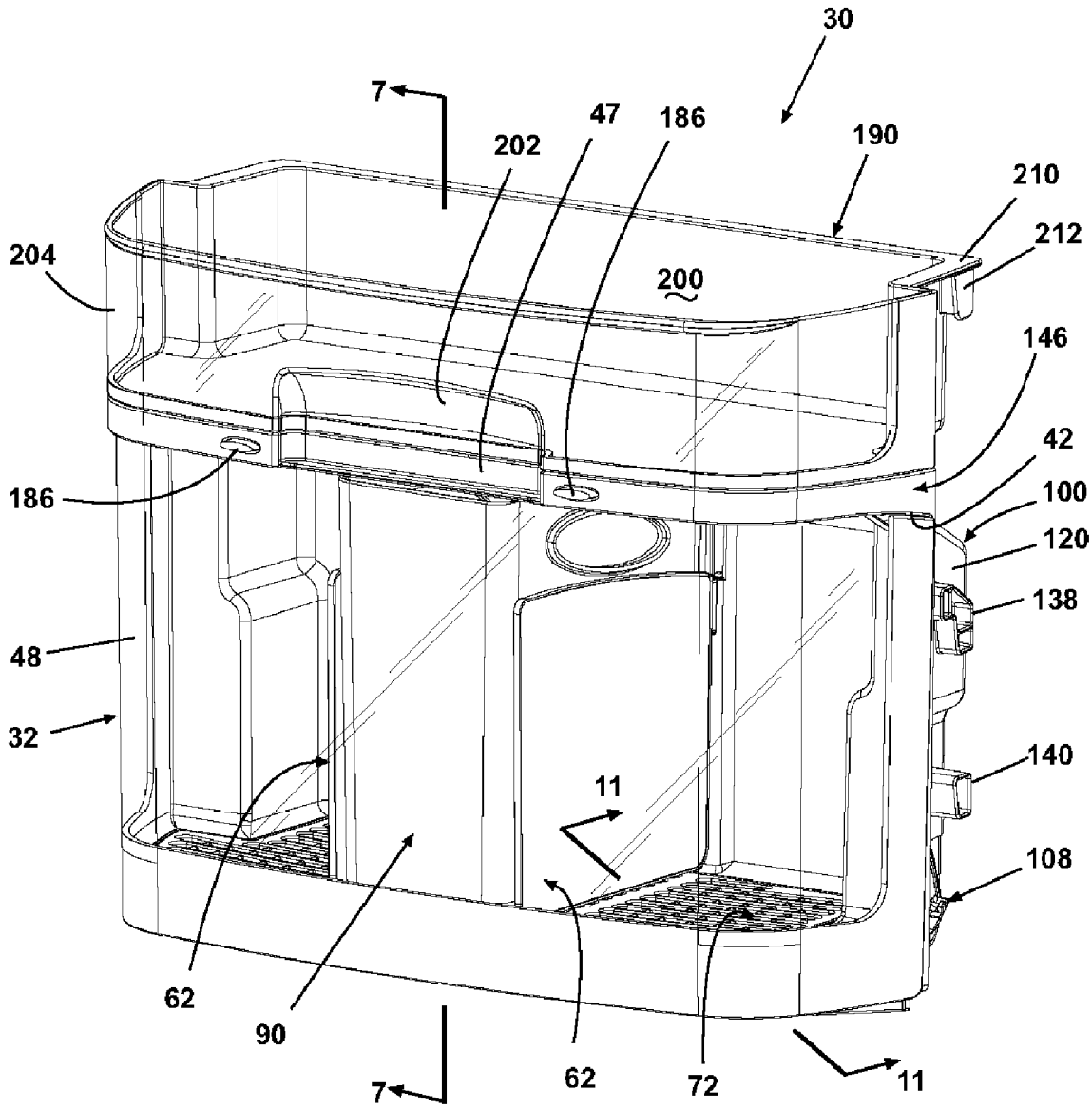
FIG. 3 is a perspective view of the storage bin assembly of FIG. 2 with a storage bin in a closed position.
Figure 4:
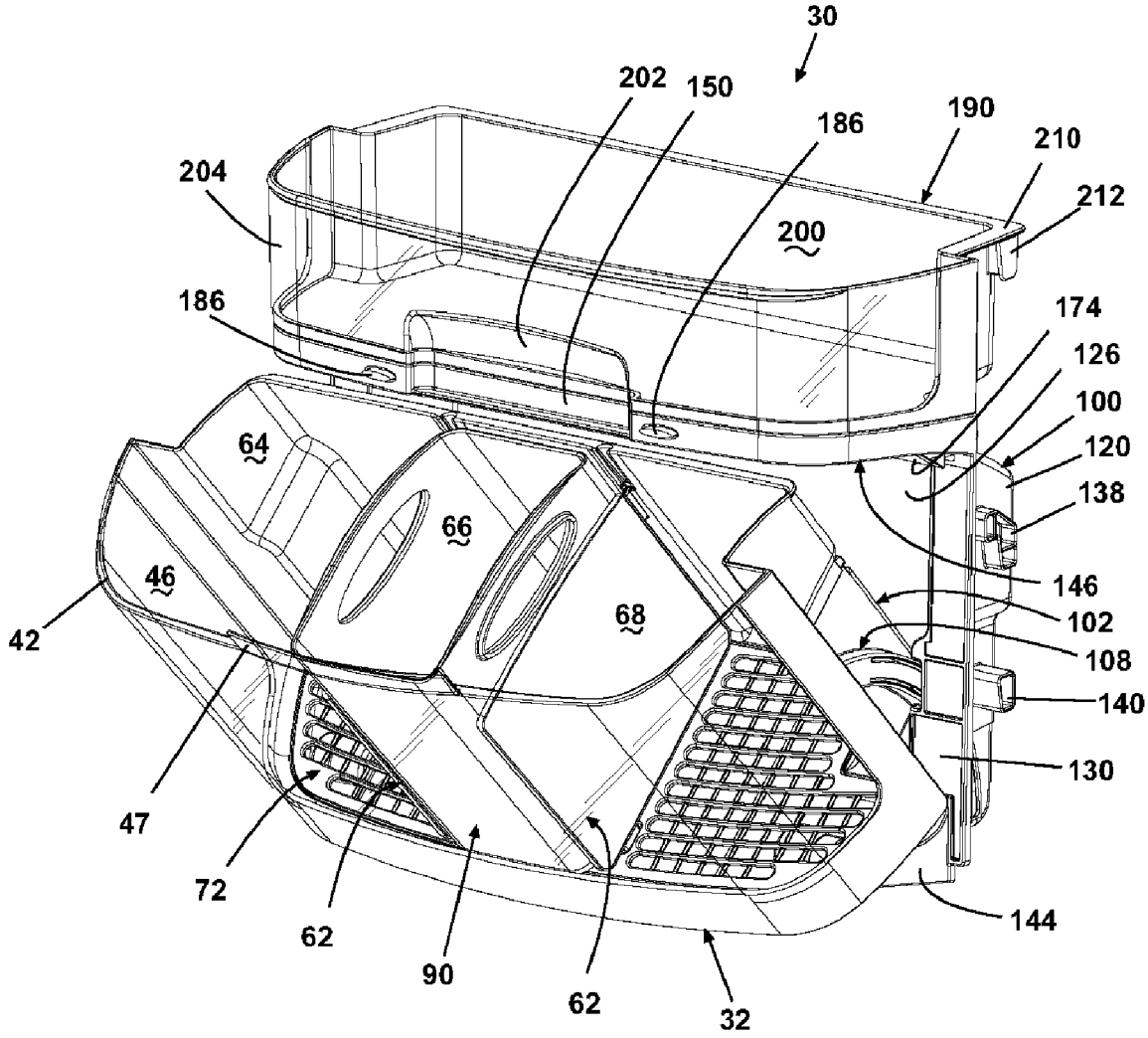
FIG. 4 is a perspective view of the storage bin assembly of FIG. 2 with the storage bin in an opened position.

Referring now to FIG. 2, the door 18 supports a storage bin assembly 30 according to one embodiment of the invention. The storage bin assembly 30 is mounted to the inner surface 22 of the door 18 and stores food items, particularly produce items, such as fruits and vegetables, in a storage bin 32. The storage bin 32 is shown in FIG. 2 and FIG. 3 in a closed position and can be moved to an open position, as shown in FIG. 4, to access the interior of the storage bin 32.

Figure 5:
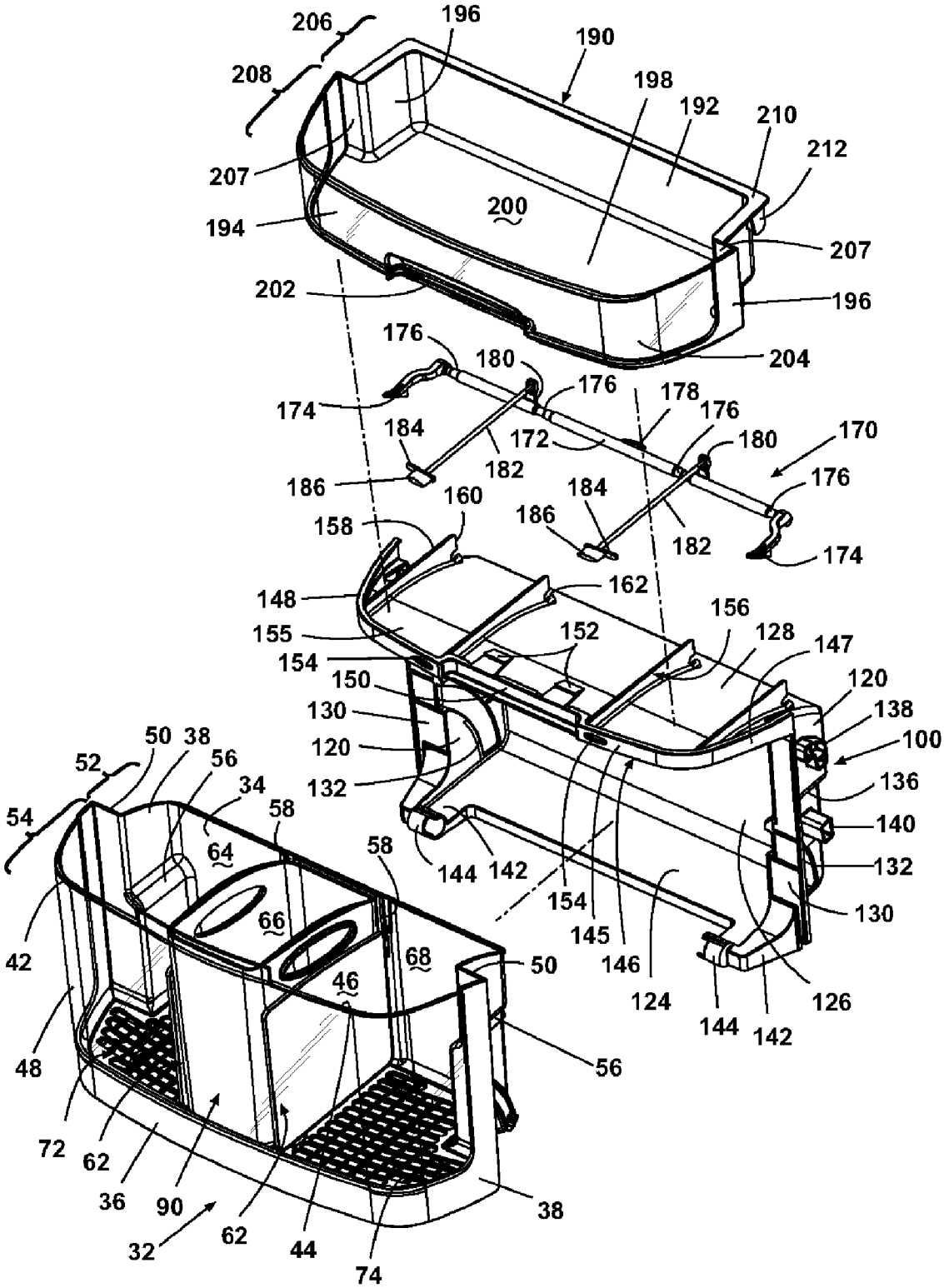
FIG. 5 is an exploded view of the storage bin assembly of FIG. 2 showing a storage bin, a housing, a lock assembly, and a secondary storage bin.
Figure 6:
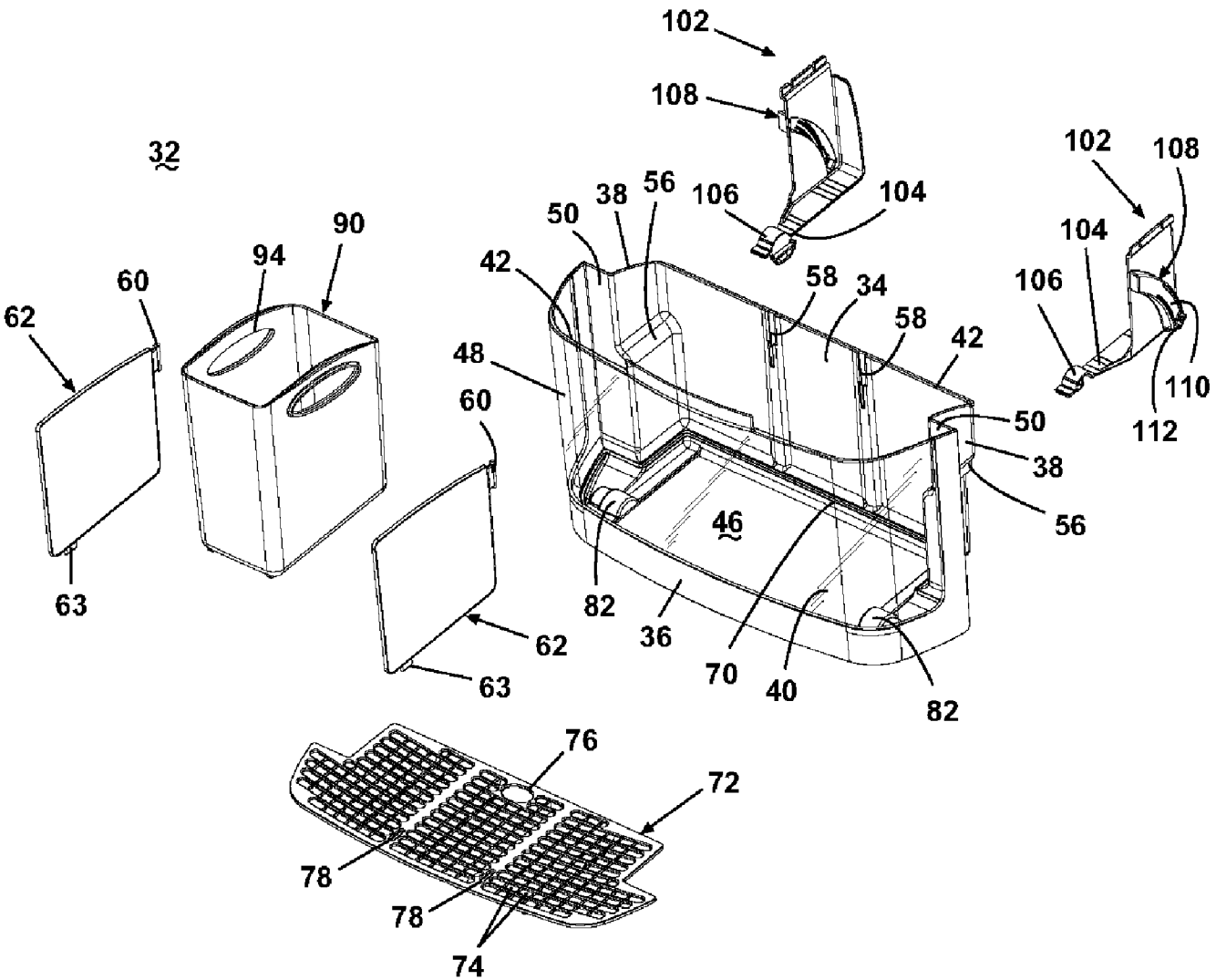
FIG. 6 is an exploded view of the storage bin from the storage bin assembly of FIG. 2.

Referring particularly to FIGS. 5 and 6, the storage bin 32 comprises a peripheral wall formed by a rear wall 34 and a front wall 36 joined by a pair of side walls 38. The peripheral wall is closed at a lower end by a bottom wall 40 and terminates an upper edge 42 that forms an opening 44 to a recess 46 defined by the peripheral wall and the bottom wall 40. The front wall 36 includes a centrally disposed, upwardly extending handle 47 to facilitate moving the storage bin 32 between the opened and closed positions. According to one embodiment of the invention, a portion of the peripheral wall is formed by a translucent window 48 to facilitate viewing of the food items stored in the recess 46. The window 48 shown in the figures forms a portion of the front wall 36 and the side walls 38 so that the user can view the food items in the recess 46 from multiple viewing angles. The window 48 can be integrally molded or co-injection molded with the rest of the front wall 36 and the side walls 38, or the window 48 can be made as a separate piece attached to the rest of the peripheral wall. For purposes of this description, it is to be understood that transparent is considered a subset of translucent.

Each of the side walls 38 includes a lateral step 50 to effectively divide the storage bin 32 into a rear portion 52 and a front portion 54 that is wider than the rear portion 52. Additionally, each of the side walls 38 includes a horizontal ledge 56 that extends from the step 50 to the rear wall 34 such that the rear portion 52 of the storage bin 32 above the ledge 56 is wider than the below the ledge 56. Further, the upper edge 42 at side walls 38 angles downwardly from the front wall 36 to the rear wall 34 to accommodate movement of the storage bin 32 between the opened and closed positions.

The rear wall 34 comprises a pair of horizontally spaced divider mounts 58 that extend downward from the upper edge 42 for slidingly receiving mounting tabs 60 on a pair of removable dividers 62 to mount the dividers 62 in the recess 46. According to the illustrated embodiment, the dividers 62 are arranged generally orthogonal to the rear wall 34 to divide the recess 46 into multiple compartments 64, 66, 68, with each compartment 64, 66, 68 extending from the front wall 36 to the rear wall 34 so that each compartment 64, 66, 68 can be viewed through the window 48. Each of the dividers 62 further comprises a downwardly extending alignment tab 63 to help maintain the divider 62 in a generally vertical position, as will be described in more detail below. The recess 46 of the storage bin 32 can be customized by removing or inserting the dividers 62 to accommodate the types and sizes of food stored in the recess 46. For example, both dividers 62 can be mounted in the recess 46 to form the three compartments 64, 66, 68, one of the dividers 62 can be mounted in the recess 46 to form two compartments, or the dividers 62 can be omitted so that the recess 46 forms one continuous compartment. The storage bin 32 can comprise any suitable number of dividers 62 and is not limited to comprising only the two dividers 62 shown in the figures.

Figure 7:
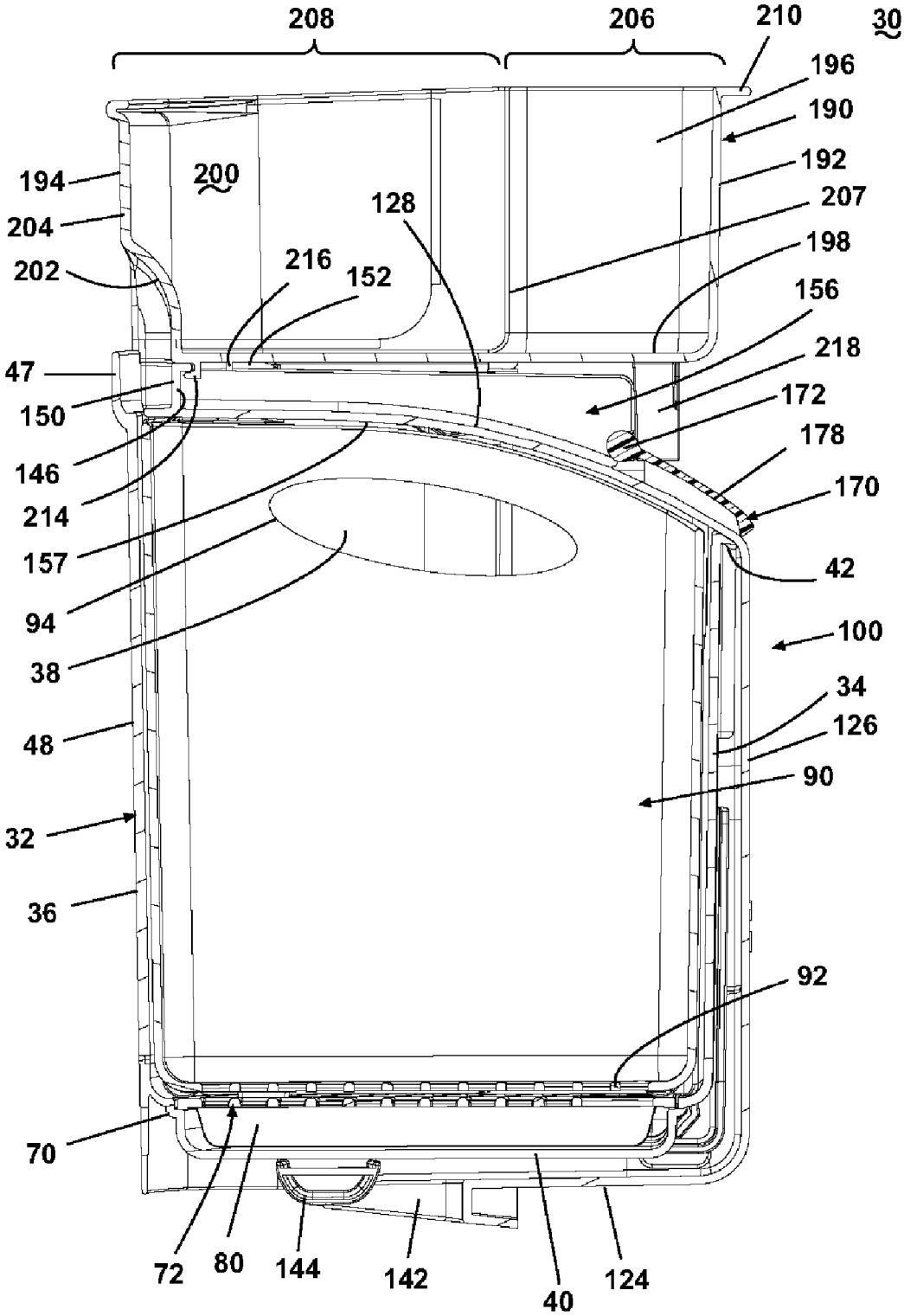
FIG. 7 is a sectional view of the storage bin assembly taken along line 7-7 of FIG. 3.

Referring additionally to FIG. 7, the bottom wall 40 is slightly inset from the peripheral wall at a lip 70 that extends around the peripheral wall for supporting a grated drain plate 72 in spaced relation with the bottom wall 40. As best viewed in FIG. 6, a plurality of apertures 74 formed in the drain plate 72 allow water or other liquids on the food items stored in the recess 46 and supported by the drain plate 72 to drain into the space between the drain plate 72 and the bottom wall 40 so that the food items do not rest in the collected liquid. The apertures 74 can any have any suitable shape and size for draining the liquid while supporting the food items. The drain plate 72 also comprises a finger slot 76 sized to receive a finger of a user to facilitate removal of the drain plate 72 from the storage bin 32 for cleaning the storage bin 32 beneath the drain plate 72 and divider slots 78 sized to receive the alignment tabs 63 on the dividers 62 to help maintain the vertical position of the dividers 62, as shown in FIG. 7. A plurality of projections 80 extend from a lower surface of the drain plate 72 to help support the drain plate 72 in spaced relation from the bottom wall 40. The bottom wall 40 further includes a pair of pivot recesses 82 in the front portion 54 of the storage bin 32, as best viewed in FIG. 6.

With continued reference to FIG. 6, the storage bin assembly 30 can optionally comprise a storage caddy 90 sized to reside in the recess 46. The storage caddy 90 according to the illustrated embodiment is sized to fit in the center compartment 66, but the storage caddy 90 can be sized to fit in any one of the compartments 64, 66, 68 formed by the dividers 62 in the recess 46. The storage caddy 90 can hold food items, such as produce items, and can be removed from the storage bin 32 for use exteriorly of the storage bin assembly 30. When the storage caddy 90 is disposed in the recess 46, a grated bottom wall 92 of the storage caddy 90 rests on the drain plate 72, as best viewed in FIG. 7, and water or other liquids on the food items in the storage caddy 90 can drain through the grated bottom wall 92 and the drain plate 72. The storage caddy 90 can further comprise a handle 94 to facilitate transport of the storage caddy 90 by a user.

Referring back to FIG. 6, the storage bin 32 is pivotally mounted to a housing 100 by a pair of pivot plates 102. The pivot plates 102 are mounted to opposite sides of the storage bin 32 at the rear portion 52 and below the ledge 56. Each pivot plate 102 comprises a forwardly extending arm 104 with a pivot member 106 that is partially received the by the corresponding pivot recess 82 on the bottom wall 40 of the storage bin 32. Additionally, the pivot plates 102 each comprise an arcuate pivot guide 108 that projects outwardly from the pivot plate 102. The pivot guide 108 includes an arcuate resilient finger 110 that terminates at an outwardly extending tang 112 with a stop 114 (FIG. 12) spaced from the resilient finger 110. While the pivot plates 102 are shown and described as being separate from the storage bin 32, it is within the scope of the invention for the structure on the pivot plates 102 to be integral with the storage bin 32. The pivot plates 102 can be secured to the storage bin 32 in any suitable manner.

Figure 8:
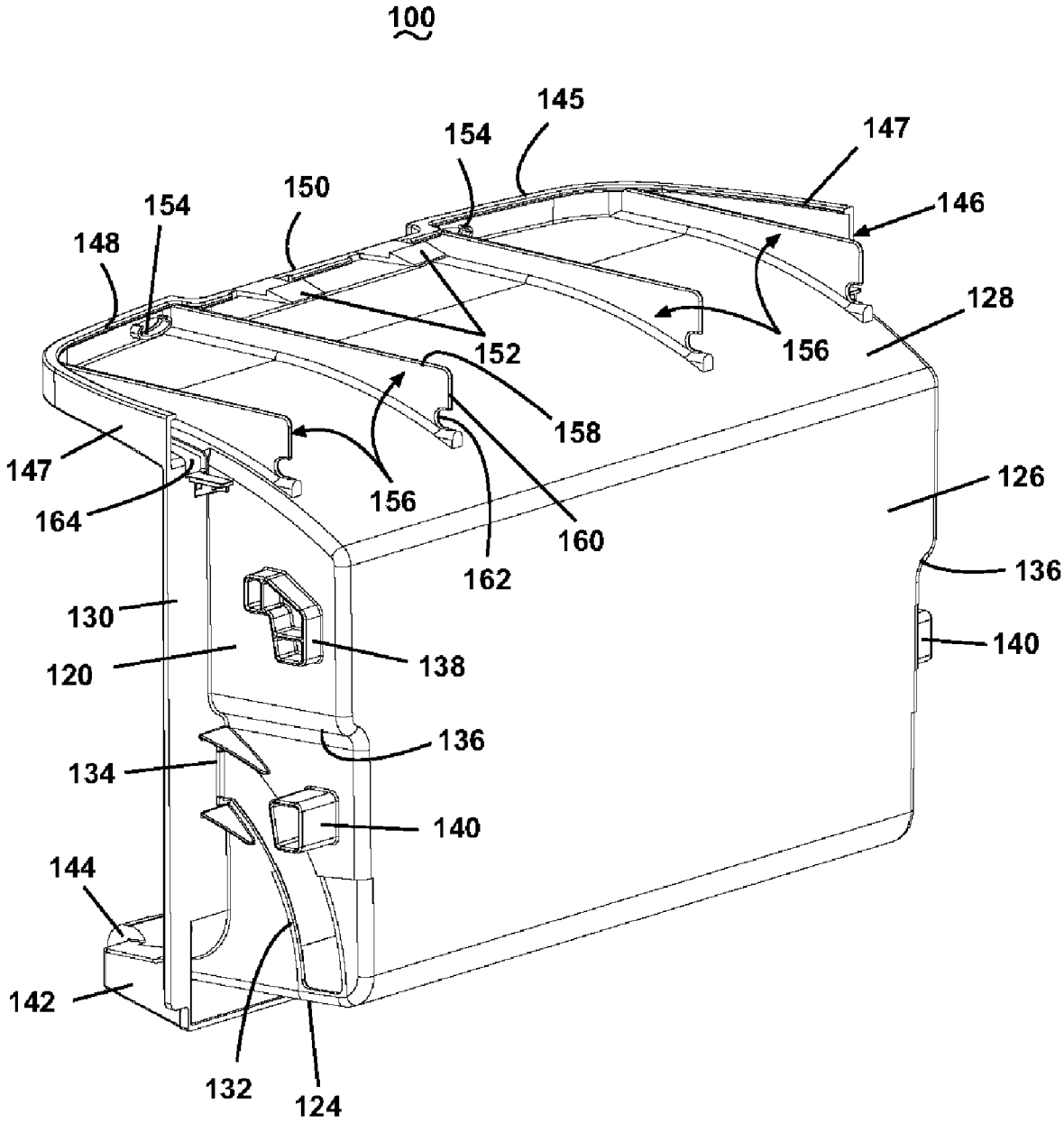
FIG. 8 is a rear perspective view of the housing from the storage bin assembly of FIG. 2.

The housing 100 to which the storage bin 32 is mounted is illustrated in FIGS. 5 and 8. Referring to FIG. 5, the housing 100 comprises a pair of spaced side walls 120 joined by a bottom wall 124, a rear wall 126, and a top wall 128 that forms a shelf. Turning now to FIG. 8, each of the side walls 120 extend forwardly of the rear wall 126 and terminates at an outwardly extending flange 130. A pair of arcuate openings 132 formed in the side walls 120 to accommodate the pivot guides 108 of the pivot plates 102 also terminate at the flanges 130. A protuberance 134 sized for receipt between the stop 114 and the finger 110 of the pivot guide 108 extends rearwardly from each of the flanges 130 at the termination of the respective arcuate opening 132. The side walls 120 each comprise a generally horizontal ledge 136 extending from the rear wall 126 to the respective flange 130 such that the distance between the side walls 120 is greater above the ledge 136 than below the ledge 136. An upper, generally L-shaped lug 138 and a lower lug 140 are located on both of the side walls 120 above and below, respectively, the ledge 136.

Referring again to FIG. 5, the bottom wall 124 of the housing 100 extends from the rear wall 126 to just beyond the flanges 130. A pair of arms 142 projects forwardly from the bottom wall 124, and the arms 142 terminate at opposed pivot member receivers 144 sized to partially receive the pivot members 106 on the pivot plates 102, as will be discussed in more detail below. Together, the pivot member receivers 144 define a pivot or rotation axis for the storage bin 32 when the storage bin 32 is mounted to the housing 100 for movement between the opened and closed positions.

Referring additionally to FIG. 8, the top wall 128 or shelf extends from the rear wall 126 and beyond the flanges 130 to terminate at an upward, generally arcuate flange 146 that spans between the flanges 130 of side walls 120. The arcuate flange 146 has a forward portion 145 between side portions 147 and comprises an upper lip 148 that is continuous around the entire arcuate flange 146, except at a central recessed region 150 in the forward portion 145 to accommodate a pair of rearwardly extending prongs 152. The arcuate flange 146 further includes an aperture 154 on each side of the recessed region 150. The top wall 128 has an upper surface 155 and a lower surface 157 and is generally flat near the forward portion 145 of the arcuate flange 146 and curves downwardly toward the rear wall 126 to accommodate the upper edge 42 of the storage bin 32. A plurality of spaced bin supports 156 extend along the upper surface 155 of the top wall 128 from the forward portion 145 toward the rear wall 128 and have a generally flat upper edge 158 and an orthognal rear edge 160 with a notch 162 formed therein. Furthermore, the top wall 128 includes a pair of lock apertures 164 formed adjacent the arcuate flange 146 at the junction between the top wall 128 and the flanges 130 of the side walls 120.

Figure 9:
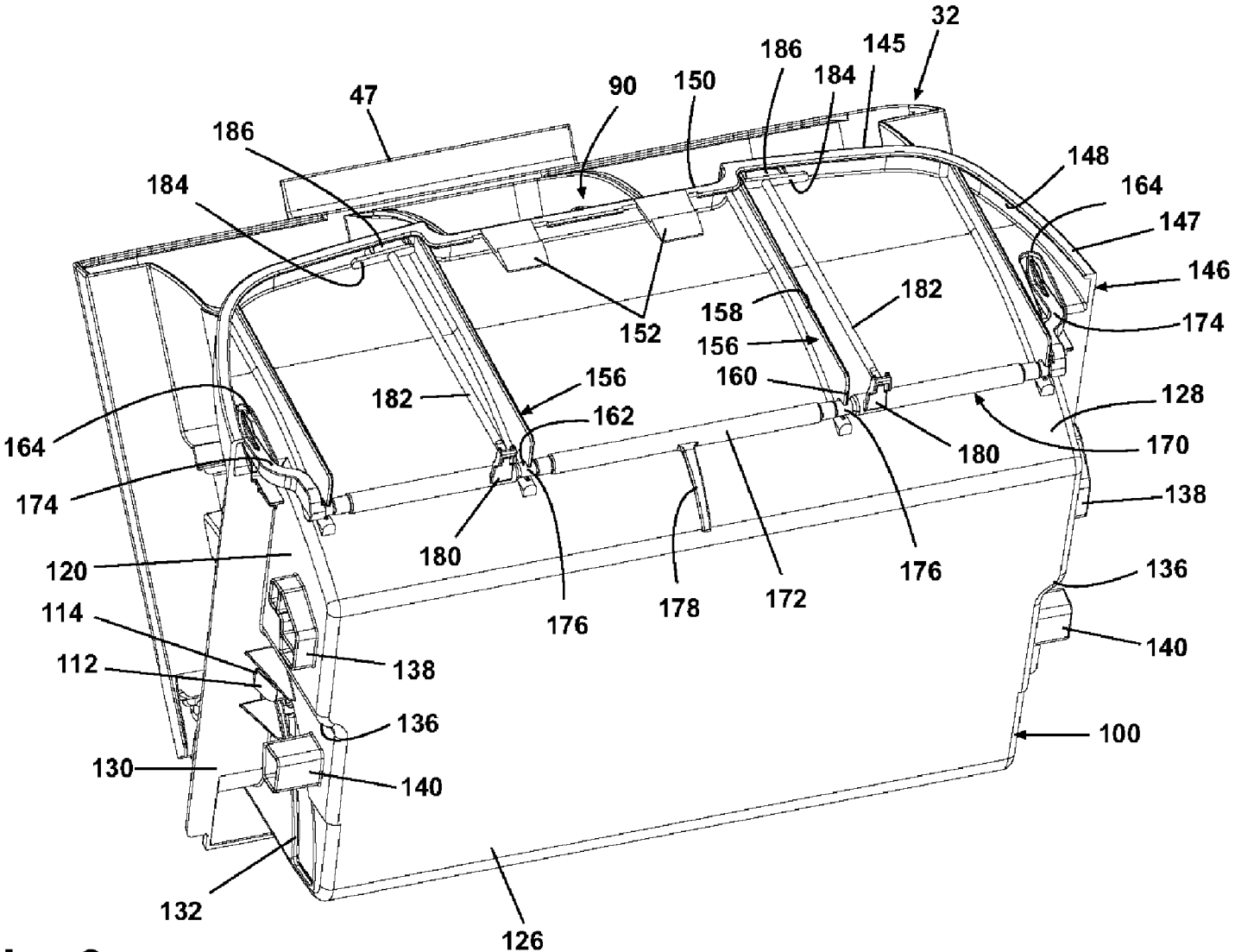
FIG. 9 is a rear perspective view of the storage bin assembly of FIG. 2 with the secondary storage bin removed to show the lock assembly.

Referring now to FIGS. 5 and 9, the housing 100 supports a lock assembly 170 comprising an elongated shaft 172 that terminates at a pair of pawls 174 sized for at least partial receipt in the lock apertures 164 of the top wall 128. The shaft 172 includes a plurality of reduced diameter sections 176 sized to be rotatably received in the notches 162 of the bin supports 156. A leaf spring 178 extends rearwardly and downwardly from the center of the shaft 172 between a pair of upwardly projecting arms 180. The lock assembly 170 further comprises a pair of lock actuators 182, each having a rod 184 that extends between the corresponding arm 180 and a button 186 with a stop 184. The buttons 186 are sized for insertion through the apertures 154 on the arcuate flange 146.

Figure 10:
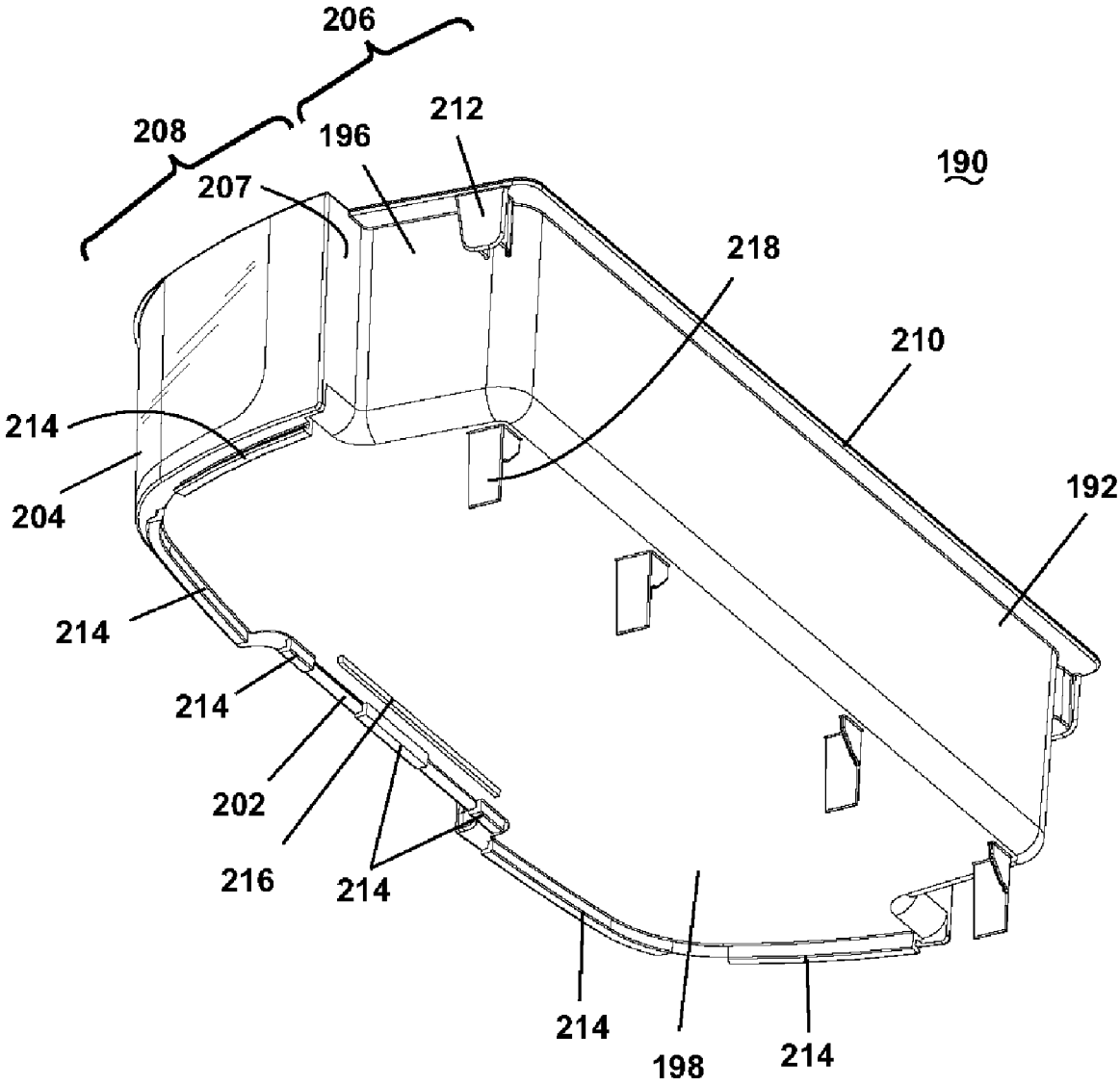
FIG. 10 is a rear perspective view of the secondary storage bin from the storage bin assembly of FIG. 2.

The storage bin assembly 30 further comprises an open-top secondary storage bin 190, which is best viewed in FIGS. 5 and 10, supported by the top wall 128 of the housing 100 for holding food items. Similar to the storage bin 32, the secondary storage bin 190 comprises a peripheral wall formed by a rear wall 192 and front wall 194 joined by a pair of side walls 196. The peripheral wall is closed at a lower end by a bottom wall 198, and the peripheral wall and the bottom wall 198 together define a recess 200. The front wall 36 includes a central recessed region 202 having a width substantially equal to the central recessed region 150 of the arcuate flange 146 on the housing top wall 128. According to one embodiment of the invention, a portion of the peripheral wall is formed by a translucent window 204 to facilitate viewing of the food items stored in the recess 200. The window 204 shown in the figures forms a portion of the front wall 194 and the side walls 196 so that the user can view the food items in the recess 200 from multiple viewing angles.

As best viewed in FIG. 10, each of the side walls 196 includes a lateral step 207 to effectively divide the secondary storage bin 190 into a rear portion 206 and a front portion 208 that is wider than the rear portion 206. The rear portion 206 comprises an upper flange 210 that extends around the side walls 196 and the rear wall 192. A pair of secondary bin lugs 212 depends from the upper flange 210 at the side walls 196 near the juncture between the side walls 196 and the rear wall 192.

The bottom wall 198 of the secondary storage bin 190 comprises several structures for mounting the secondary storage bin 190 to the top wall 128 of the housing 100. In particular, the bottom wall 198 comprises a plurality of L-shaped mounting members 214 around the periphery of the front portion 208 and a rib 216 spaced from and oriented generally parallel to the mounting members 214 at the central recessed region 202. The mounting members 214 are spaced from each other at the central recessed region 202 to accommodate the prongs 152. The bottom wall 198 further comprises a plurality of legs 218 depending therefrom near the juncture between the bottom wall 198 and the rear wall 192.

Figure 11:
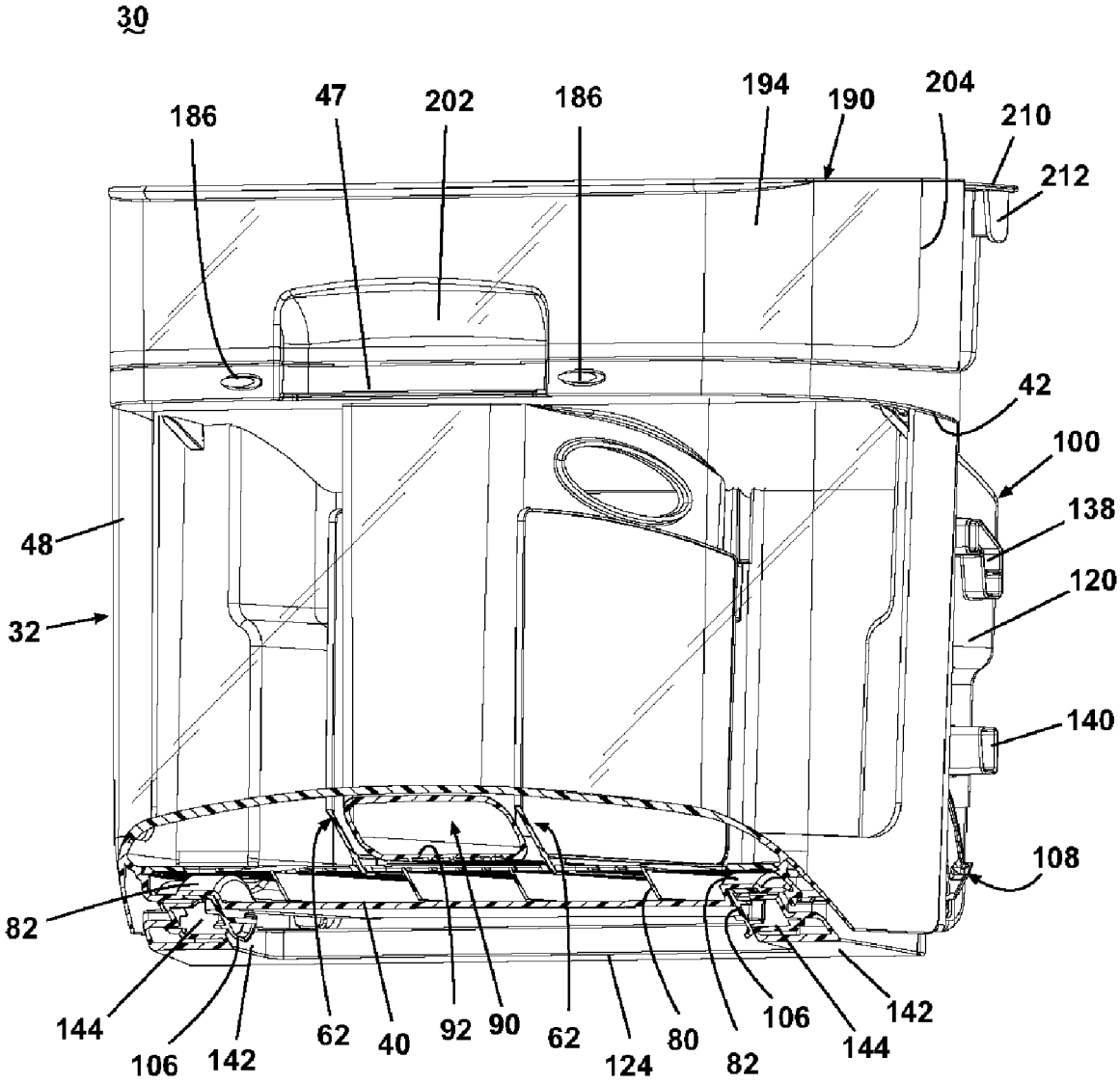
FIG. 11 is a sectional view taken along line 11-11 of FIG. 3.

When the storage bin assembly 30 is assembled, the storage bin 32 is pivotally mounted to the housing 100 through the pivot plates 120. In particular, the pivot members 106 of the pivot plates 102 mate with the pivot member receivers 144 in the pivot recesses 82 on the storage bin 32, as shown in FIG. 11, to define a pivot axis about which the storage bin 32 pivots between the opened and closed positions. Additionally, the pivot guides 108 are received by the arcuate openings 132 in the housing side walls 120. The fingers 110 can be deflected toward one another so that the tangs 112 clear the side walls 120 when mounting the storage bin 32 to the housing 100. When the storage bin 32 is in the closed position, the rear portion 52 is disposed between the side walls 120 of the housing 100 with the steps 50 adjacent and generally parallel with the flanges 130, and the forward portion 54 projects forwardly of the side walls 120 and the bottom wall 124 and is located directly beneath the top wall arcuate flange 146 with the handle 47 received by the central recessed region 150. Furthermore, the upper edge 42 of the storage bin 32 abuts the lower surface 157 of the housing top wall 128 to seal the recess 46 from air circulating exteriorly of the storage bin 32, as will be discussed in more detail below.

The storage bin 32 is secured in the closed position by the lock assembly 170. The lock assembly 170 is mounted to the top wall 128 of the housing 100 with the notches 162 of the bin supports 156 rotatably receiving the reduced diameter sections 176 of the shaft 172 and the pawls 174 projecting through the lock apertures 164, as shown in FIG. 9. The leaf spring 178 abuts the top wall 128 and biases the shaft 172 to rotate forwardly and force the pawls 174 through the lock apertures 164 and against the steps 50 to hold the steps 50 against the flanges 130 on the housing side walls 120, as shown in FIG. 1, and thereby hold the storage bin 32 in the closed position. The leaf spring 178 also biases the lock actuators 182 forwardly such that the buttons 186 project through the apertures 154 on the arcuate flange 146. As seen in FIG. 9, forward movement of the lock actuators 182 is limited by the stops 184 adjacent the buttons 186 contacting the arcuate flange 146.

The secondary storage bin 190 is mounted to the top wall 128 of the housing 100 and hides the lock assembly 170 from view. In particular, the mounting members 214 of the secondary storage bin 190 receive the lip 148 on the arcuate flange 146, and the prongs 158 mate with the rib 216 to prevent rearward movement of the secondary storage bin 190 relative to the housing 100. The legs 218 extend down from the secondary storage bin 190 adjacent the shaft 172 of the lock assembly 170 to help retain the shaft 172 in the notches 162 of the bin supports 156. The upper edges 158 of the bin supports 156 support the bottom wall 198 of the secondary storage bin 190 in a generally horizontal orientation.

With the storage bin 32 and the secondary storage bin 190 mounted to the housing 100, the storage bin assembly 30 is a modular assembly that can be mounted to the door 18 in any desired location according to the preferences of the user. To mount the storage bin assembly 30 to the door 18, the storage bin assembly 30 is held with the housing rear wall 126 in a generally vertical position parallel to the rear wall 26 of the door inner surface 22 with the upper and lower lugs 138, 140 and the secondary bin lugs 212 positioned between adjacent pairs of lugs 28 on the door 18. The user then moves the storage bin assembly 30 toward the rear wall 26 of the door inner surface 22 until the rear wall 126 of the housing 100 abuts the inner surface 22. The user slides the storage bin assembly 30 downward until the L-shaped upper lugs 138 abut the corresponding pair of lugs 28 on the door 18 to prevent further downward movement of the storage bin assembly 30. In this position, all three sets of lugs, the upper and lower lugs 138, 140 and the secondary bin lugs 212, are securely positioned behind the corresponding pairs of lugs 28 on the door 18, which are shown in phantom in FIG. 12. While the interaction between the upper lugs 138 and the corresponding pair of lugs 28 hold the storage bin assembly 30 in a desired vertical position, the interaction of all the lugs 138, 140, 212 with the corresponding pairs of lugs 28 prevents movement of the storage bin assembly 30 away from the door 18. When the storage bin assembly 30 is mounted to the door 18, the housing side walls 120, rear wall 126, bottom wall 124, and rear portion of the top wall 128 are disposed between the side walls 24 of the door 18, along with the rear portion 52 of the storage bin 32 and the rear portion 206 of the secondary storage bin 190. Further, the upper flange 210 of the secondary storage bin 190 extends toward the inner surface of the door 18 to visually conceal the underlying portions of the storage bin assembly 30 and the lugs 28. The storage bin assembly 30 can easily be removed from the door 18 by performing the just described process in reverse order and, if desired, mounted to another position on the door 18.

When the storage bin assembly 30 is mounted to the door 18, the housing 100 effectively becomes an extension or part of the door 18 that supports the storage bin 32 and the secondary storage bin 190 on the door 18. Moreover, the storage bin assembly 30 can be altered so that the housing 100 or other similar structure is formed integrally with the door 18 for mounting the storage bin 32 and the secondary storage bin 190 to the door 18. In either arrangement, when the storage bin 32 is in the closed position, the upper edge 42 abuts and seals with the top wall 128 or shelf of the housing 100 and thereby effectively forms a seal between the storage bin 32 and the door 18. As used herein, the "seal" formed between the storage bin 32 and the housing 100 or the door 18 corresponds to abutting surfaces that prevent air circulating exteriorly of the storage bin 32 from circulating into and through the recess 46 and drying the food items stored in the recess 46. While it is within the scope of the invention for the "seal" to be hermetic or completely air-tight, it is not required. Rather, the seal need only be good enough to substantially disrupt the natural circulation of air through the storage bin 32, which would otherwise occur and serve to dry out and cool the air within storage bin. This can be accomplished with closely adjacent surfaces, while it is preferred that the surfaces abut one another to substantially prevent the air from flowing into and through the recess 46 when the storage bin 32 is in the closed position.

An exemplary description of the operation of the storage bin assembly 30 follows. It will be apparent to one of ordinary skill that the operation procedure can proceed in any logical order and is not limited to the sequence presented below. The following description is for illustrative purposes only and is not intended to limit the invention in any manner.

Figure 12:
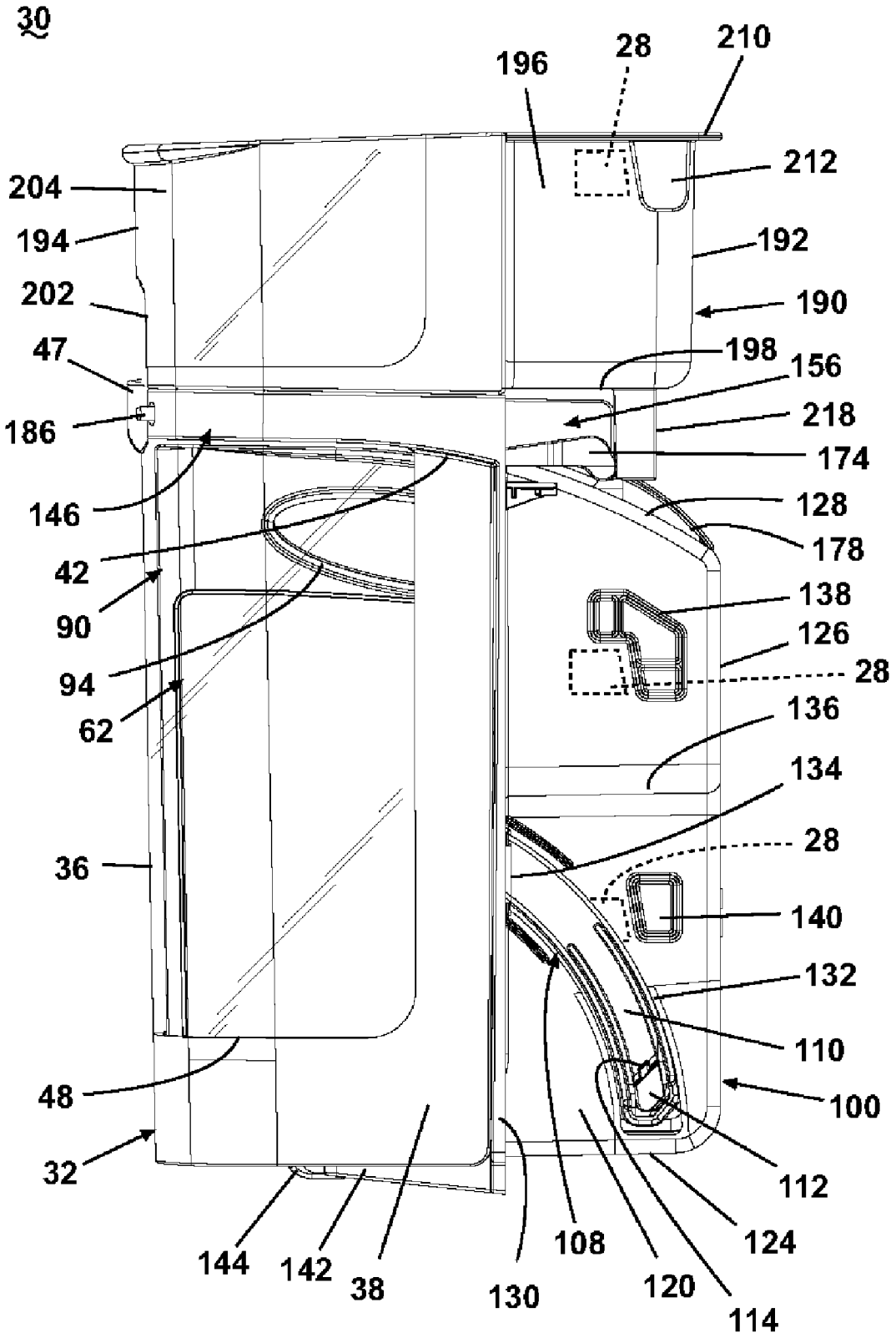
FIG. 12 is a side view of the storage bin assembly of FIG. 2 with the storage bin in the closed position.
Figure 13:
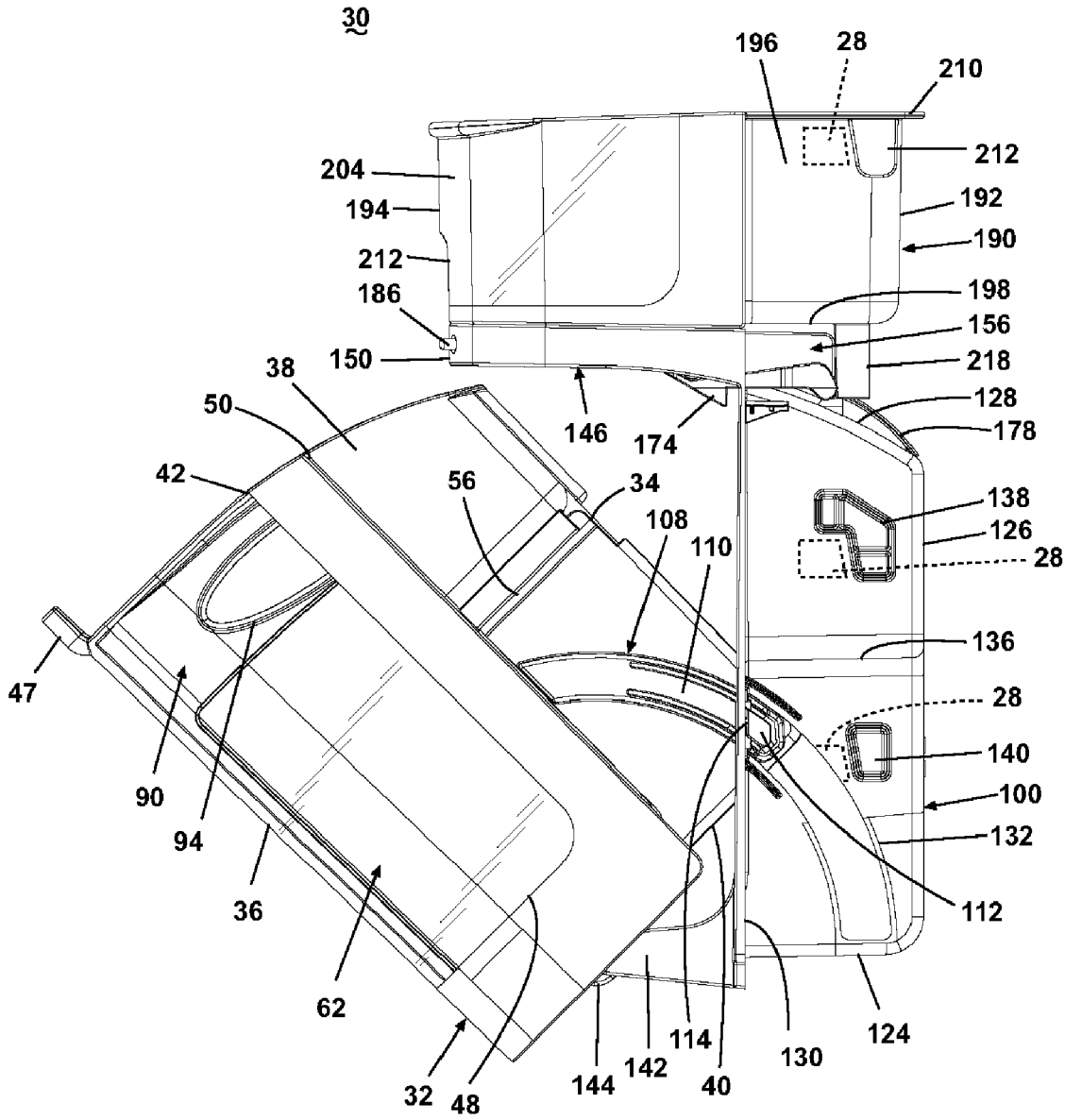
FIG. 13 is a side view of the storage bin assembly of FIG. 2 with the storage bin in the opened position.

For illustrative purposes, the storage bin assembly 30 is assumed to be mounted to the door 18 with the storage bin 18 initially in the closed position, as illustrated in FIG. 12. When the user desires to access the recess 46 to remove food items from the recess 46 or to place items in the recess 46, the user depresses the buttons 186 to displace the lock actuators 182 rearwardly for rotating the shaft 172 against the bias of the leaf spring 178, which deflects upon depression of the buttons 186, and thereby pivoting the pawls 174 upward through the lock apertures 164. As a result, the pawls 174 are removed from abutting contact with the steps 50, and the storage bin 32 is free to pivot about the pivot axis defined by the pivot members 106 and the pivot member receivers 144. To effect the movement of the storage bin 32, the user can insert one or more fingers between the handle 47 and the central recessed region 150 in the housing top wall 128 and grasp the handle 47 upon depression of the buttons 186 to facilitate pivoting the storage bin 32 from the closed position to the opened position. After the storage bin 32 moves from the closed position and the user releases the buttons 186, the leaf spring 178 forces the shaft 172 to rotate forwardly and thereby return the pawls 174 to their original position. As the storage bin 32 moves to the opened position, the pivot guides 108 slide along the arcuate openings 132 in the housing side walls 120 until the protuberance 134 is received between the stop 114 and the finger 110 adjacent the tang 112, as shown in FIG. 13. The interaction between the protuberance 134 and the tang 112 prevents further forward pivoting of the storage bin 32, and the stop 114 prevents the fingers 110 from being accidentally deflected inward toward each other. When the storage bin 32 is in the opened position, the user can access all the compartments 64, 66, 68 of the recess 46 through the opening 44 and can remove and replace the storage caddy 90, if desired.

To close the storage bin 32, the user simply applies a force to the storage bin 32 to pivot the storage bin 32 toward the housing 100. When the steps 50 contact the pawls 174 of the lock assembly 170, the steps 50 ride along the pawls 174 to thereby force the pawls 174 upward through the lock apertures 164 so that the storage bin 32 can continue to pivot toward the housing 100. Movement of the pawls 174 induces rotation of the shaft 172 against the bias of the leaf spring 178. As the storage bin 32 rotates to the closed position, the pivot guides 108 slide through the arcuate openings 132 in the housing side walls 120. When the storage bin 32 has finished rotating to the closed position, the leaf spring 178 forces shaft 172 to rotate forwardly and the pawls 174 to pivot through the lock apertures 164 into abutting contact with the steps 50 to secure the storage bin 32 in the closed position. Thus, the lock assembly 170 is automatically engaged when the storage bin 32 is moved to the closed position without any actuation by the user.

At any time before, during, or after operation of the storage bin assembly 30, the user can store food items in the secondary storage bin 190. While the secondary storage bin 190 has been shown and described as an open-top bin, the secondary storage bin 190 can have any suitable structure, including a flat shelf with or without a guard to retain the food items on the shelf. Alternatively, it is within the scope of the invention to eliminate the secondary storage bin 190 from the storage bin assembly 30. When the secondary storage bin 190 is not employed, the top wall 128 of the housing 100 is preferably designed to hide the lock assembly 170 and provide a pleasing aesthetic appearance.

The storage bin assembly 30 has been shown and described as comprising multiple lugs 138, 140, 212 that mate with the lugs 28 on the door 18 for removably mounting the storage bin assembly 30 to the door 18. However, it is within the scope of the invention for the storage bin assembly 30 and the door 18 to comprise other types of mounting structures for mounting the storage bin assembly 30 to the door 30. It will be apparent to one of ordinary skill in the refrigerator art that many types of structures exist and are suitable for mounting food item supports, such as the storage bin assembly 30, to the door 18.

The storage bin assembly according to the invention provides an easily accessible, highly visible storage compartment for food items. Because the storage bin assembly is mounted to the door, the space in the chilled chamber is efficiently utilized, and more food items can fit within the chilled chamber. Additionally, the portion of the chilled chamber directly adjacent the door is inherently a few degrees warmer than the rest of the chilled chamber. This slightly warmer environment is desirable for produce items because the higher temperature helps to keep the produce items fresher for longer periods of time. For example, the temperature of the chilled chamber can be about 37° F., and the temperature in the recess of the storage bin can be about 2-3° F. more than the temperature of the chilled chamber. In addition to providing a warmer environment, the interior of the storage bin in the closed position is sealed from the air circulating in the chilled chamber to prevent the food items in the storage bin from prematurely drying. Another advantage of the inventive storage bin assembly is its modularity; the storage bin assembly can easily be removed from the door and mounted to the door in any desirable location. While the storage bin assembly is capable of achieving all of the advantages described above, it is not necessary for the storage bin assembly to have all of advantages in a single unit to be within the scope of the invention, which is defined in the appended claims.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household refrigerator comprising:

a cabinet that defines at least one chilled chamber with an open face;

a door movably mounted to the cabinet to selectively close the open face of the chilled chamber and having an inner surface facing the chilled chamber when the door closes the chilled chamber;

a storage bin having a peripheral wall that defines a recess and terminates at an upper edge defining an opening, the storage bin pivotally mounted to the door for movement between an opened position where the recess can be accessed through the opening and a closed position where the opening is sealed with the door;

a pair of pivot members on a bottom portion of storage bin; and a receiving portion configured to receive the pivot members in the door, the receiving portion defining a pivot axis for movement of the storage bin between the open and closed positions, wherein the pivot axis is located substantially center of the storage bin, such that a center of gravity of the storage bin varies between the open and closed position.

2. The household refrigerator according to claim 1 wherein the storage bin further comprises at least one divider to divide the recess into multiple storage compartments.

3. The household refrigerator to claim 1 and further comprising at least one storage caddy removably mounted in the recess of the storage bin.

4. The modular storage bin assembly according to claim 1, wherein the storage bin comprises a bottom wall and a drain plate spaced from the bottom wall to support food items placed in the storage bin above the bottom wall.

5. The modular storage bin assembly according to claim 4, wherein the drain plate is removably mounted to the storage bin.

6. The household refrigerator according to claim 1, wherein the door comprises a shelf that seals with the upper edge when the storage bin is in the closed position.

7. The household refrigerator according to claim 1 and further comprising a second storage bin mounted to the shelf.

8. The household refrigerator according to claim 1, wherein the door further comprises a housing removably mounted to the door, and the storage bin is pivotally mounted to the housing, the housing further comprising the receiving portion configured to receive the pivot members on the bottom wall of the housing.

9. The household refrigerator according to claim 8 and further comprising pivot plates mounted to opposite sides of the storage bin proximate a rear portion of the storage bin, the pivot plates each having an arcuate pivot guide projecting outward from the pivot plate and an arcuate channel in the opposing sidewalls of the housing, the arcuate channels configured to accommodate the arcuate pivot guides.

10. A modular storage bin assembly for mounting to a household refrigerator door, the modular storage bin assembly comprising:

a housing having a bottom and top wall and a first and second opposing sidewall, the housing configured to be mounted to the refrigerator door;

a storage bin defining a recess and having an opening to provide access to the recess, the storage bin pivotally mounted to the housing for movement between an opened position where the recess can be accessed through the opening and a closed position where the opening is sealed with the housing;

a pair of pivot members on a bottom portion of storage bin; and a receiving portion configured to receive the pivot members on the bottom wall of the housing, the receiving portion defining a pivot axis for movement of the storage bin between the open and closed positions, wherein the pivot axis is located substantially center of the storage bin, such that a center of gravity of the storage bin varies between the open and closed position.

11. The modular storage bin assembly according to claim 10 and further comprising pivot plates mounted to opposite sides of the storage bin proximate a rear portion of the storage bin, the pivot plates each having an arcuate pivot guide projecting outward from the pivot plate and an arcuate channel in the opposing sidewalls of the housing, the arcuate channels configured to accommodate the arcuate pivot guides.

12. The modular storage bin assembly according to claim 10, wherein the housing further comprises means for removably mounting the housing to the refrigerator door.

13. The modular storage bin assembly according to claim 12, wherein the mounting means further comprises at least one lug configured to be mated with at least one lug on the refrigerator door for removably supporting the housing on the refrigerator door.

14. The modular storage bin assembly according to claim 10, wherein the storage bin comprises a peripheral wall that terminates at an upper edge that defines the opening and abuts the housing to form the seal when the storage bin is in the closed position.

15. The modular storage bin assembly according to claim 14, wherein the housing comprises a shelf with an upper surface and a lower surface that the upper edge abuts against to form the seal.

16. The modular storage bin assembly according to claim 15 and further comprising a second storage bin supported by the upper surface of the shelf.

17. The modular storage bin assembly according to claim 10 and further comprising at least one lock to secure the storage bin to the housing in the closed position.

18. The modular storage bin assembly according to claim 10, wherein the storage bin comprises a handle to facilitate movement of the storage bin between the opened and closed positions.

19. The modular storage bin assembly according to claim 10, wherein the storage bin comprises a peripheral wall, and at least a portion of the peripheral wall is translucent.

20. The modular storage bin according to claim 10 and further comprising at least one divider to divide the recess into multiple storage compartments.

21. The modular storage bin assembly according to claim 20, wherein the at least one divider is removable.

22. The modular storage bin according to claim 10 and further comprising at least one storage caddy removably mounted in recess of storage bin.

23. The modular storage bin according to claim 10, wherein the storage bin comprises a bottom wall and a drain plate spaced from the bottom wall to support food items placed in the storage bin above the bottom wall.

* * * * *